US005172991A

United States Patent [19]

Ikeda

[11] Patent Number: 5,172,991

[45] Date of Patent: Dec. 22, 1992

[54] METHOD FOR DETECTING THE LENGTH OF SHEET IN A PRINTER

[75] Inventor: Kazuaki Ikeda, Tokyo, Japan

[73] Assignee: Seikosha Co., Ltd., Tokyo, Japan

[21] Appl. No.: 801,333

[22] Filed: Dec. 2, 1991

[30] Foreign Application Priority Data

Jan. 19, 1991 [JP] Japan ..... 4793/91

[51] Int. Cl.[5] ..... B41J 29/20; B41J 29/44

[52] U.S. Cl. ..... 400/708; 400/279; 400/320; 400/596; 400/706

[58] Field of Search ..... 400/708, 711, 706, 707.1, 400/279, 820, 595, 596, 708.1

[56] References Cited

U.S. PATENT DOCUMENTS 4,265,556 5/1981 Krieg et al. ..... 400/708 X
4,272,204 6/1981 Quinn et al. ..... 400/708 X

FOREIGN PATENT DOCUMENTS 0258774 11/1986 Japan ..... 400/279
0297170 12/1986 Japan ..... 400/708
0025073 2/1987 Japan ..... 400/708
0280061 12/1987 Japan ..... 400/711
0074672 4/1988 Japan ..... 400/711

*Primary Examiner*—Edgar S. Burr
*Assistant Examiner*—Christopher A. Bennett
*Attorney, Agent, or Firm*—Jordan and Hamburg

[57] ABSTRACT

In the determination of the length of a sheet that has been inserted in a printer, an optical sensor scans the length of the sheet as it is fed into the printer, and a counter is controlled to provide a count corresponding to the length of the sheet. When the sensor encounters a mark on the sheet, such as a line, it provides an output indicating that the sheet is not present. This erroneous output is corrected by moving the sensor laterally of the sheet to a position displaced from the mark to enable further sensing of the presence of the sheet in a region that does not include the mark.

7 Claims, 5 Drawing Sheets

METHOD FOR DETECTING THE LENGTH OF SHEET IN A PRINTER

FIELD OF THE INVENTION

The present invention relates to a method for detecting the length of a sheet, for example, paper, in a printer.

BACKGROUND OF THE INVENTION

A printer is known in which the length of a sheet therein is detected, and the number of printing lines is set corresponding to the detected length thereof. Using a sheet length detecting method, an optical sensor fixed in a specific position determines the presence or absence of the sheet while pulling in the sheet. The sheet length is obtained based on this determination.

There is, however, a drawback to the above detecting method. The sensor is fixed, and hence, when ruled lines are preprinted on the sheet, the sensor is incapable of detection of the sheet at the ruled line printed portions. A determination of absence of the sheet results. A misjudgment about a length of sheet hence occurs, and it follows that the number of printing lines is erroneously set.

SUMMARY OF THE INVENTION

It is an object of this invention to provide a method for detecting the length of a sheet in a printer, which is capable of accurately detecting the sheet length.

To obviate the foregoing problems, a method is provided for detecting the length of a sheet in a printer, comprising the step of detecting the sheet length with an optical sensor when the sheet is inserted. In accordance with the invention, the sensor is moved in a manner to steer it clear of undetectable portions of the sheet, thus enabling accurate detection of the sheet length.

The optical sensor is preferably mounted on a carrier of a printing head.

BRIEF DESCRIPTION OF THE DRAWINGS

One embodiment of the present invention will now be described with reference to the accompanying drawings.

DESCRIPTION OF THE PREFERRED EMBODIMENTS

Figure 1:
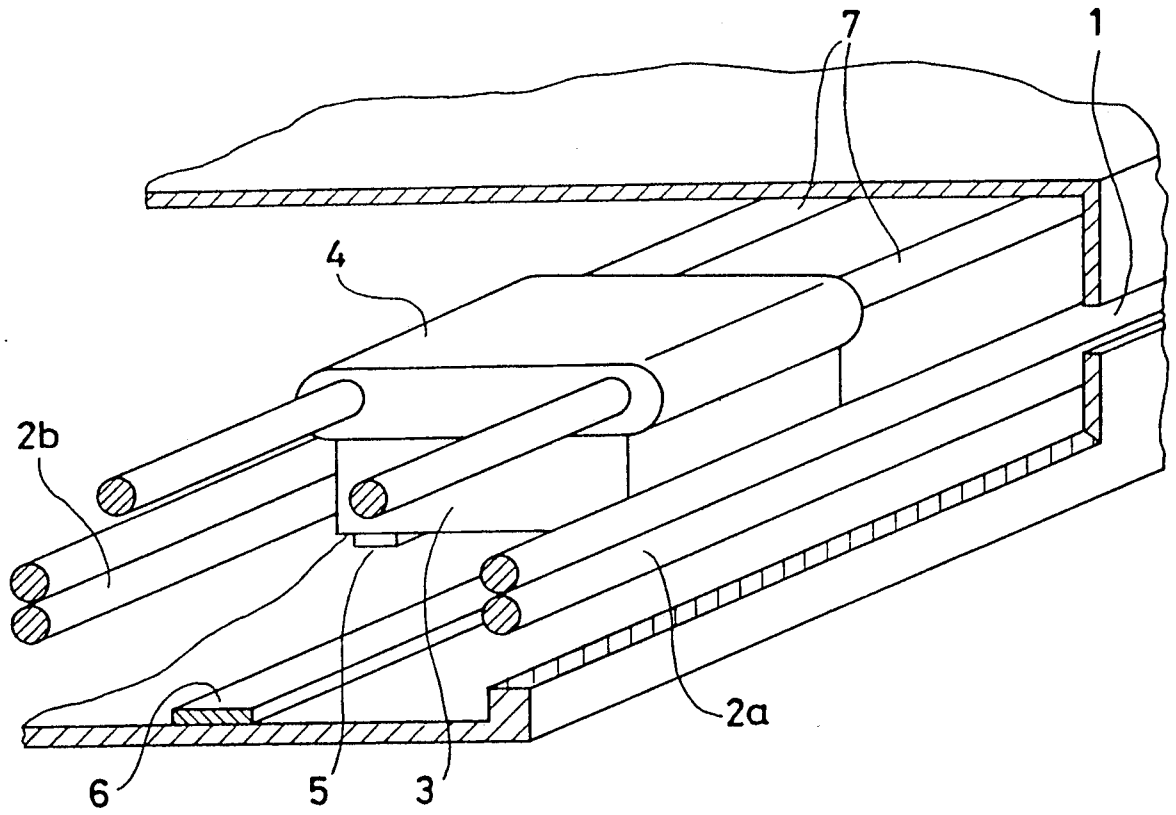
FIG. 1 is a schematic diagram illustrating the principal portion of a printer.

Referring now to FIG. 1, the numeral 1 represents an opening in a printer through which a sheet is inserted and discharged; 2*a*, 2*b* denote rollers for pulling in and discharging charging the sheet; 3 denotes a printing head; 4 denotes a carrier for moving the printing head 3; 5 denotes an optical sensor for detecting the presence or absence of the sheet, composed of light emitting/receiving elements and mounted on the carrier 4; 6 denotes a platen colored in, e.g., black to make the platen itself optically distinguishable from the sheet; and 7 denotes a guide rod for supporting the carrier 4.

Figure 2:
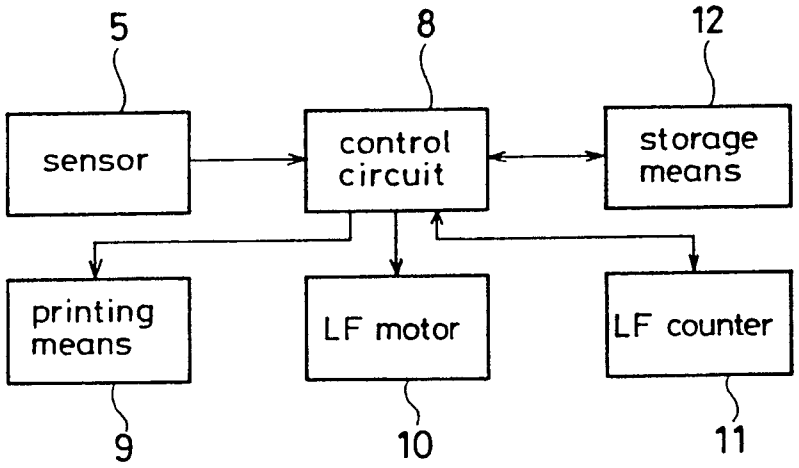
FIG. 2 is a block diagram depicting the principal portion of the printer

FIG. 2 is a block diagram depicting the principal elements of the printer. The numerals in FIG. 2 that are the same as those of FIG. 1 indicate the same components. Numeral 8 depicts a control circuit for controlling operations of the printer as a whole. The numeral 9 denotes a printing means comprised of the printing head 3 and the carrier 4; 10 depicts an LF (Line Feed) motor for driving the rollers 2*a*, 2*b*; 11 depicts an LF counter for counting the number of line feeds as a function of the amount of rotation of the LF motor 10; and 12 depicts a storage means for storing positional data of the carrier 4.

Figure 3:
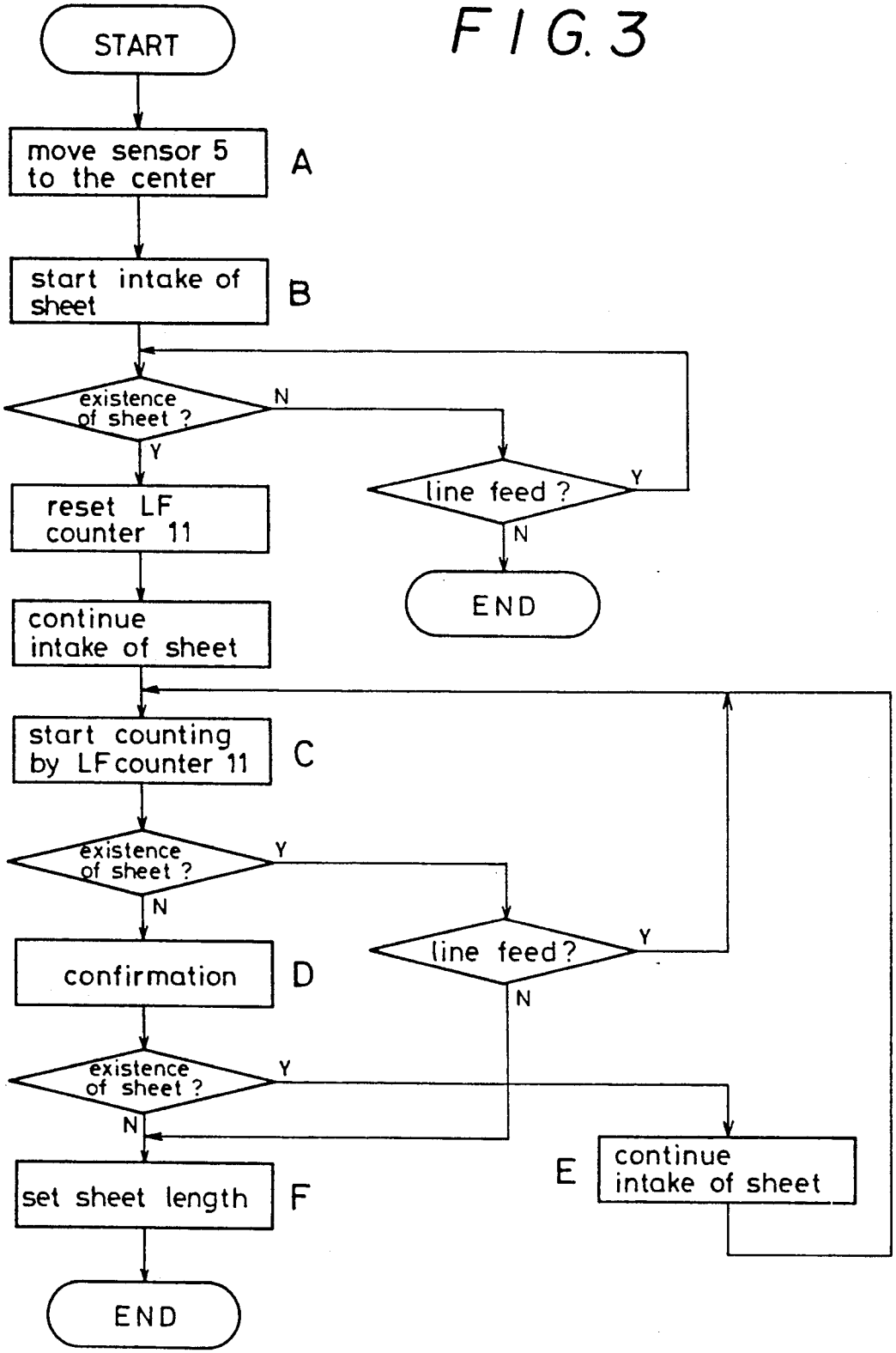
FIG. 3 is a flowchart to aid in the explanation of the operation of detecting a sheet length.
Figure 4:
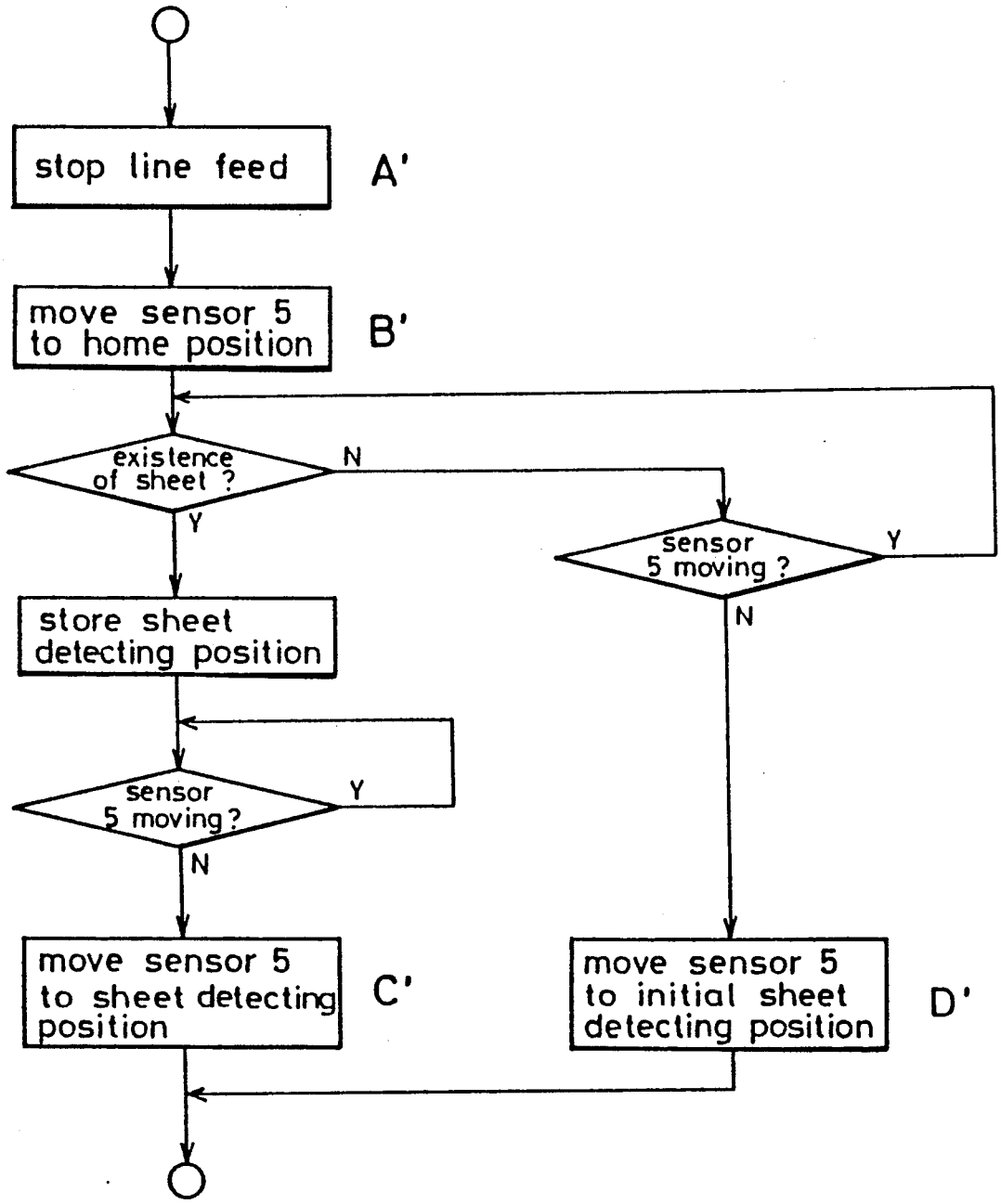
FIG. 4 is a flowchart for aiding in the explanation of the operation of detecting the sheet length.

Referring next to FIGS. 3 and 4, the operation of detecting a sheet length will now be described. Initially, the carrier 4 moves in response to an instruction to feed in the sheet, to place the sensor 5 in a predetermined position, e.g., at the center of the sheet between the left and right margins (step A).

Next, the rollers 2*a*, 2*b* are rotated in a direction to feed in the sheet. If the sheet has already been inserted into the opening 1, the sheet is fed in by rotation of the rollers 2*a*, 2*b* (step B). It is assumed that a line 13 is, as illustrated in FIG. 5, preprinted on the sheet.

Figure 5A:
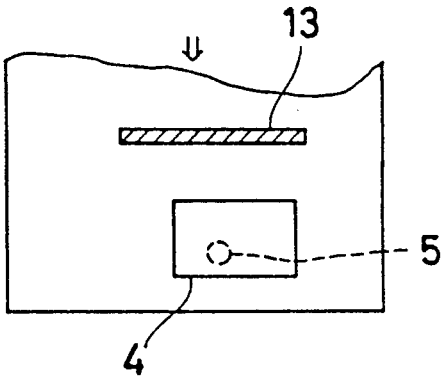
FIG. 5(*a*)–(*c*) are an explanatory diagram showing the operation of detecting the sheet length.
Figure 5B:
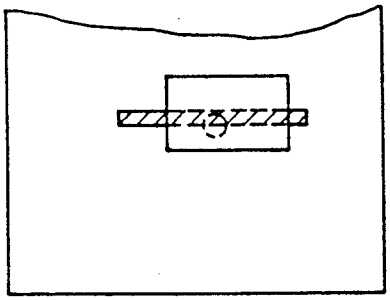

The sheet is now fed in, and when the sensor 5 senses the presence of the sheet, the LF counter 11 is reset. At this time, the LF counter 11 counts a quantity corresponding to the rotation of the rollers 2*a*, 2*b* (step C). More specifically, as illustrated in FIG. 5*a*, the sheet moves in the direction of the arrow. The sensor 5 senses the presence of the sheet. Subsequently, the sheet is pulled further in, and when the line 13, as depicted in FIG. 5*b*, enters a monitor region of the sensor 5, the sensor provides an output indicating the absence of the sheet.

Upon this indication of the absence of the sheet, a confirmation thereof is performed (step D).

The confirming operation at the step D will be explained in conjunction with the flowchart of FIG. 4.

Upon the indication of the absence of the sheet, the rollers 2*a*, 2*b* stop rotating, and the feed of the sheet stops, correspondingly. The LF counter 11 likewise ceases to count (step A').

Next, the carrier 4 moves to the home position (e.g. at a margin, step B').

Figure 5C:
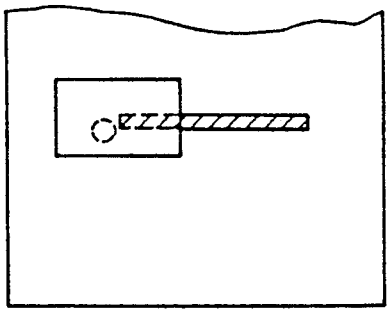

Upon this movement, the sensor 5 senses the presence of the sheet since it is now positioned in a region spaced from the line 13. At this time, the positional data of the carrier 4 is stored in the storage means 12. The carrier 4 stops in the home position. Thereafter, as depicted in FIG. 5*c*, the carrier 4 resumes its movement to a position indicated by the positional data stored in the storage means 12 (step C').

The operation now reverts to the routine of FIG. 3. The rollers 2*a*, 2*b* resume their rotation. The feed in of the sheet continues, and the LF counter 11 also continues to count (step E).

After the trailing edge of the sheet has been pulled in, and when making a determination of the absence of the sheet, the operation returns to the routine of FIG. 4. In this case, even when moving the sensor 5 in accordance with the step B', the determination of the presence of the sheet is not made. Hence, the carrier 4 moves back to the initial monitoring position (step D').

In the determination of the presence or absence of the sheet in the next routine of FIG. 3, the absence of the sheet is determined. The sheet length is set based on the count value in the LF counter 11 at that time (step F).

The sheet length is detected by the operations discussed above. A printing format is set based on this sheet length. Printing is then effected.

In the embodiment described above, when changing a sheet presence determination to an absence determination, the carrier 4 moves to the home position in the confirming operation. The process is not, however, so limited. For instance, the carrier 4 can temporarily move to the left side home position and then to the right side of the sheet. The presence or absence of the sheet may thereafter be detected. With this arrangement, even if the line 13 is printed as far as the left side of the sheet, the presence of the sheet can be determined if there is a space at the right side of the sheet. A more accurate determination of the sheet length can be made in this manner.

According to the present invention, if the sheet includes portions, i.e., printed portions, in which the sensor can not determine the presence of the sheet, the sensor moves to steer clear of such portions. In this manner, the presence or absence of the sheet is determined. It is therefore possible to accurately detect the sheet length.

Although the present invention has been fully described by way of example with reference to the accompanying drawings, it is to be understood that various changes and modifications will be apparent to those skilled in the art. Therefore, unless such changes and modifications depart from the scope of the invention, the should be construed as being included therein.

What I claim is:

1. In the method for detecting the length of a sheet in a printer, comprising the step of detecting the sheet length with an optical sensor while advancing the sheet in the lengthwise direction of the sheet in the printer, the improvement comprising moving said sensor in a direction transverse to the lengthwise direction of the sheet in the printer to steer clear of undetectable portions of said sheet, and detecting the length of the sheet at a position clear of said undetectable portions.

2. The method of claim 1, wherein said optical sensor is mounted on a carrier of a printing head, said step of moving comprising moving said carrier.

3. A method for determining the length of a sheet as it is fed in a printer, the sheet having side edges and the printer having means for advancing the sheet in the lengthwise direction of the sheet in the printer, wherein the printer has a sensor for detecting the presence or absence of a sheet, said method comprising positioning said sensor at a first position between said side edges of said sheet, and sensing the presence and absence of said sheet with said sensor while said sensor is at said first position and while said sheet is being advanced in said lengthwise direction, stopping said sheet and displacing said sensor from said first position to a second position toward one of said side edges upon the sensing of the absence of said sheet by said sensor, and the advancing said sheet and sensing the presence and absence of said sheet with said sensor while said sensor is at said second position.

4. The method of claim 3 further comprising, upon sensing of the absence of said sheet at said second position, stopping said sheet and displacing said sensor from said second position to a third position toward the other side edge of said sheet, and then advancing said sheet and sensing the presence and absence of said sheet with said sensor while said sensor is at said third position.

5. The method of claim 3, wherein said step of positioning said sensor at a first position comprises moving said sensor to a center point between said side edges of said sheet.

6. The method of claim 3, wherein said step of displacing said sensor to a second position comprises moving said sensor to a home position at the left margin of said sheet.

7. The method of claim 3 comprising stepping a counter as said sheet is advanced, whereby said counter stores a count corresponding to the advance of said sheet, and stopping the stepping of said counter while said sensor is moved from said first position to said second position.

* * * * *